United States Patent [19]

Wang

[11] Patent Number: 4,596,365

[45] Date of Patent: Jun. 24, 1986

[54] SPOOL MEANS USED IN FLYING A KITE

[76] Inventor: Kun-Meng Wang, No. 57, Lane 50, Chung Cheng Rd., Pei Hsin Ts'un, Tai Pao Hsiang, Chia-I, Taiwan

[21] Appl. No.: 675,188

[22] Filed: Nov. 27, 1984

[51] Int. Cl.[4] ..... B65H 75/40

[52] U.S. Cl. ..... 242/96

[58] Field of Search ..... 242/96, 99, 100, 84.53, 242/84.5 R, 156, 156.2, 107.4 R, 107.6; 244/155 A

[56] References Cited

U.S. PATENT DOCUMENTS

| | | | |
|---|---|---|---|
| 807,965 | 12/1905 | Rice | 242/107.6 |
| 2,451,100 | 10/1948 | Lecompte | 242/107.6 |
| 3,908,928 | 9/1975 | Okada | 242/107.4 R |
| 4,106,719 | 8/1978 | Haverland | 242/96 |
| 4,176,807 | 12/1979 | Kwon | 242/96 |

FOREIGN PATENT DOCUMENTS

| | | | |
|---|---|---|---|
| 429599 | 5/1935 | United Kingdom | 242/107.6 |

*Primary Examiner*—John M. Jillions

[57] ABSTRACT

The present invention relates to a spool assembly used in flying a kite, which assembly mainly comprises a straight stem member having a groove formed thereon, a detent means mounted within the groove of the stem member, and a spool secured to the stem member, in which the releasing and rewinding of the string wound on a spool of the spool assembly are controlled by the detent means. The spool is relatively flat and is mounted as close as possible to the stem member so that the user's hand is subject to the least torque.

1 Claim, 4 Drawing Figures

SPOOL MEANS USED IN FLYING A KITE

BACKGROUND OF THE INVENTION

The present invention is concerned with a spool assembly used in flying a kite.

Kite-flying is a popular sport in many countries. Generally, the conventional kite is made of a sheet of paper or cloth stretched on a light wooden frame in order to be floated in the wind at the end of a string. Conventionally, the string connecting the kite is only wound on a simple spool whereby the operator has to pay much attention to control the payout and rewinding of the string around the spool manually. However, since the operation of such conventional spool is inconvenient, there is a need for an improved spool assembly which can be easily operated.

SUMMARY OF THE INVENTION

The present invention is related to a spool assembly for use in kite flying. Such a spool assembly according to the present invention mainly comprises a stem member having a groove formed thereon, a detent means mounted within the groove of the stem member, and a spool secured to the stem member. With such arrangement the payout and rewinding of the string wound around a spool of the spool assembly are controlled by the detent means.

The principal object of the present invention is to provide a spool assembly for flying a kite, in which the string wound on the spool can be paid out by manually operating a crank attached to the spool assembly when a ratchet attached to the spool is engaged with a detent pawl of the detent means, and can be rewound by depressing a trigger of the detent means so as to cause the detent pawl to disengage from the ratchet.

The details and advantages of the present invention will become more apparent from the following description of a preferred embodiment in conjunction with the accompanying drawings.

DETAILED DESCRIPTION OF THE INVENTION

Figure 1:
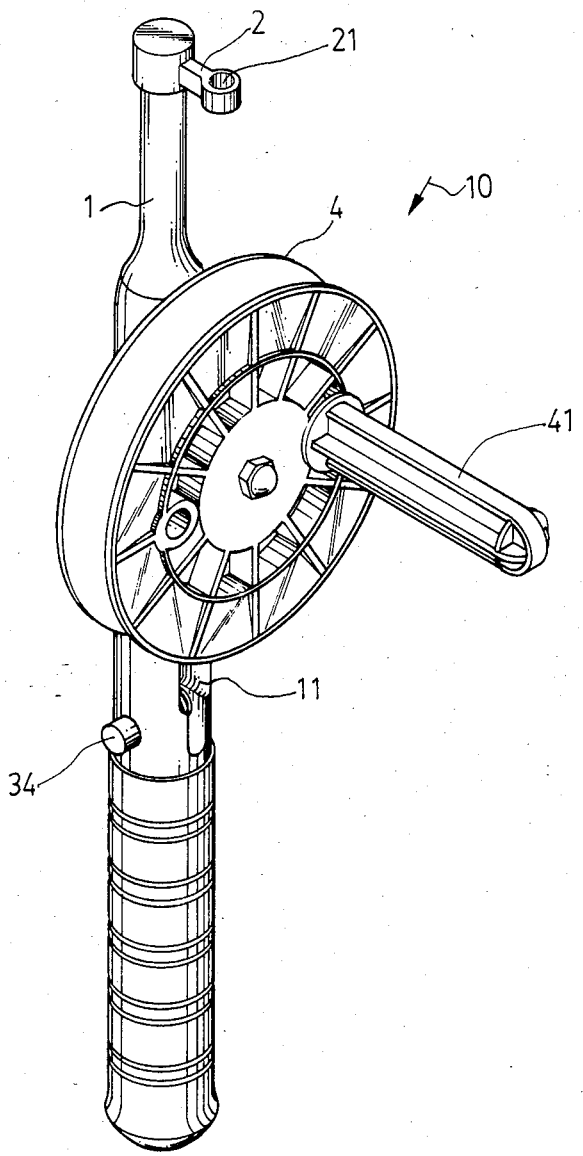
FIG. 1 is a perspective view of a preferred embodiment showing a spool assembly in accordance with the present invention.

With reference now to the drawings, and in particular FIG. 1, a spool assembly constructed according to the present invention is shown generally by reference numeral (10). The spool assembly includes a stem member (1) which has a groove (11) formed in the middle portion thereof, and a string guide (2) including a string guide eyelet (21). Stem member (1) is a substantially cylindrical structure which may be formed by casting aluminum alloy, or may be formed by wood, plastics material or the like.

Figure 2:
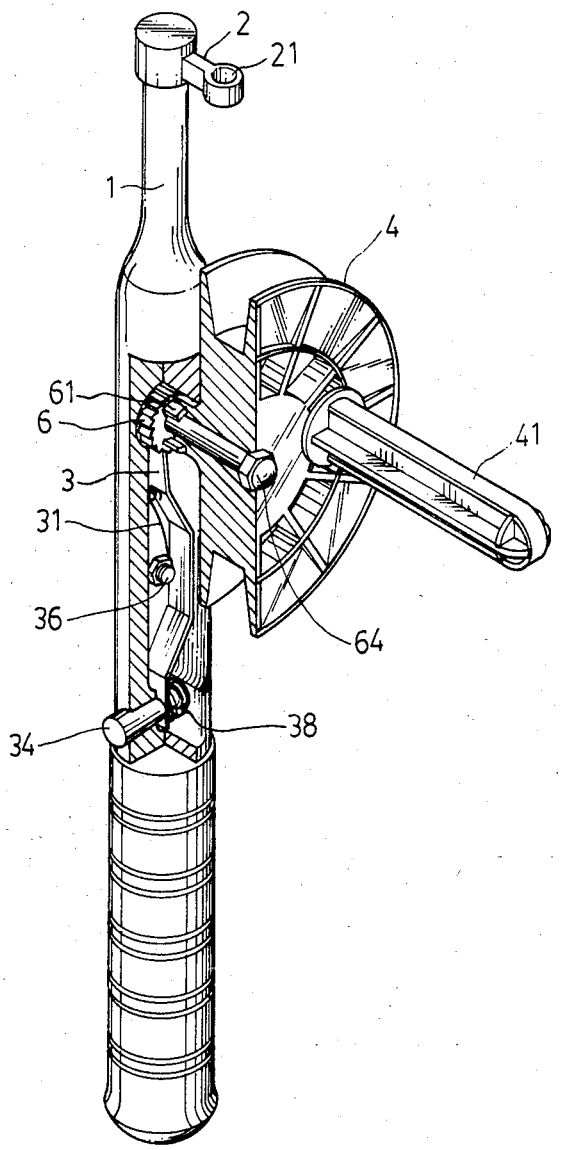
FIG. 2 is a perspective view of the spool assembly of FIG. 1 with the stem member and the spool being partially cut away for the purpose of clarity.
Figure 4:
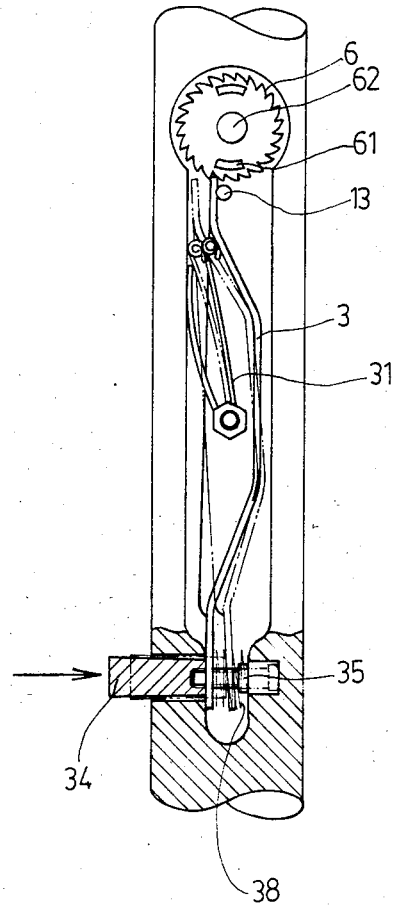
FIG. 4 is a schematical view showing engagement and disengagement between the detent means and the spool in solid and phantom lines with part of the stem member being cut away for the purpose of clarity.

Referring now to FIGS. 2 and 4, the detent means according to the present invention is provided with a detent pawl (3), a spring (31), a trigger (34) and a spiral spring (38). As shown in FIG. 2, the detent pawl (3) and the spring (31) are secured to the groove of the stem member (1) by bolt (36) such that the spring (31) can bias one end of the detent pawl (3) against a pin (13) (FIG. 4) attached to the groove of the stem member (1). The trigger (34) is substantially a hollow cylinder closed at one end, the inner surface of which trigger (34) is provided with threads. A bolt (35) passes through the spiral spring (38) and the other end of the detent pawl (3) and then connects with the trigger (34). With such an arrangement, the detent pawl (3) can be moved away from the pin (13) when the trigger (34) is depressed, as shown in FIG. 4.

Figure 3:
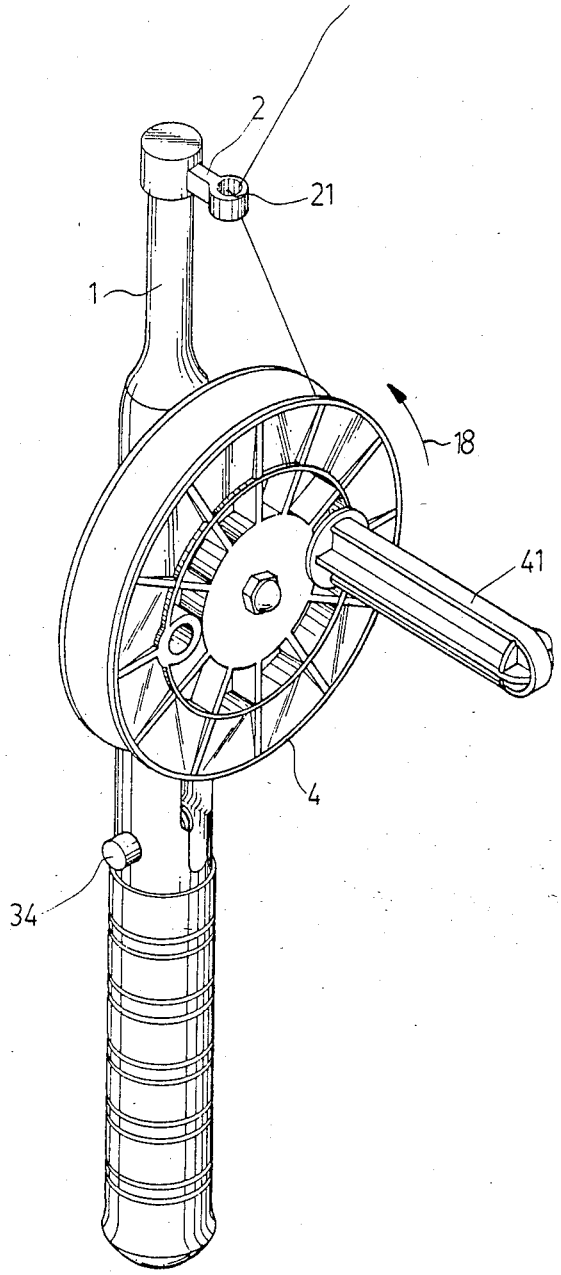
FIG. 3 is a perspective view of the spool assembly of FIG. 1 showing a string with one end thereof passed through a string guide opening.

Turning now to FIGS. 2 and 3, the spool of the spool means includes a spool (4) which consists of a spool shaft and two end flanges which are formed integrally with the shaft by molding techniques. As shown in FIGS. 2 and 4, the spool shaft has a hole (62) along its length, and a pair of recesses at one end thereof. The detent means further includes a ratchet (6) having a pair of protrusions (61) received in the corresponding recesses of the spool (4), the ratchet being located within the groove (11). Spool (4) and ratchet (6) are secured to the stem member (1) by bolt (64) whereby the ratchet (6) will be engaged with the detent pawl (3) in normal condition. Furthermore, a crank (41) is attached to the spool (4) for rotating the spool (4) during takein of the string.

In operation, one end of the string is attached to the spool (4) through a hole formed in the spool (4), and the other end of the string is passed through the string guide eyelet (21) and connected to a kite. Since the engagement between the ratchet (6) and the detent pawl (3) can prevent rotation of the spool, the string wound on the spool (4) cannot be paid out and is only allowed to rewind, by actuating the rotating handle (41). When trigger (34) is depressed, the detent pawl (3) will disengage from the ratchet (6) and thus the spool (4) may rotate in the direction indicated by arrow (18) in FIG. 3 by the drag force resulted from the string connecting the kite floating in the air.

I claim:

1. In a spool assembly for flying a kite comprising a relatively flat spool for the string of a kite with a crank attached thereto for cranking the spool, a detent means for selectively allowing or preventing the rotation of the speed in the direction of releasing the string wound on the spool, a guide means for guiding the string, and a stem member on which the spool, detent means and guide means are mounted, a portion of said stem member forming a handle for holding the spool assembly the axis of the stem member being perpendicular to the rotary axis of the reel; the improvement wherein the stem member is a straight structure and having one end defining said handle and the other end having mounted thereon the guide means, the spool having a diameter substantially greater than its axial length to form a relatively flat structure and is so mounted that a plane perpendicular to the center of its rotational air is close to the axis of the stem member, the spool being mounted between the handle and the guide means, the guide means being an eyelet supported at a position close to the axis of the stem member and the orientation of the eyelet being parallel to the axial direction of the stem member, said stem member having a longitudinal groove formed in the middle portion thereof parallel to the axis of the stem member; said detent means comprising a ratchet attached coaxially to said spool, a pawl, a spring for biasing said pawl to engage said ratchet and a trigger for releasing said pawl from said ratchet; said pawl, said ratchet and said spring being secured to and located within the confines of said groove of the stem member.

* * * * *